US007312750B2

(12) United States Patent
Mao et al.

(10) Patent No.: US 7,312,750 B2
(45) Date of Patent: Dec. 25, 2007

(54) ADAPTIVE BEAM-FORMING SYSTEM USING HIERARCHICAL WEIGHT BANKS FOR ANTENNA ARRAY IN WIRELESS COMMUNICATION SYSTEM

(75) Inventors: Jian Mao, Gaithersburg, MD (US); Oscar Frederick Somerlok, III, Potomac, MD (US)

(73) Assignee: Comware, Inc., Rockville, MD (US)

( * ) Notice: Subject to any disclaimer, the term of this patent is extended or adjusted under 35 U.S.C. 154(b) by 300 days.

(21) Appl. No.: 11/071,249

(22) Filed: Mar. 4, 2005

(65) Prior Publication Data

US 2005/0206564 A1 Sep. 22, 2005

Related U.S. Application Data

(60) Provisional application No. 60/554,408, filed on Mar. 19, 2004.

(51) Int. Cl.
*H01Q 3/22* (2006.01)
*H01Q 3/26* (2006.01)

(52) U.S. Cl. ..... 342/377; 342/373

(58) Field of Classification Search ..... 342/367, 342/373, 377, 378, 383; 455/69, 101, 562.1
See application file for complete search history.

(56) References Cited

U.S. PATENT DOCUMENTS 6,049,307 A 4/2000 Lim
7,088,288 B1 * 8/2006 Margolese et al. ..... 342/377
7,099,383 B2 * 8/2006 Struhsaker et al. ..... 375/222
2003/0222818 A1 12/2003 Regnier et al.
2005/0143132 A1 * 6/2005 Proctor et al. ..... 455/561

FOREIGN PATENT DOCUMENTS

EP 1394966 A2 3/2004

OTHER PUBLICATIONS

Godara, L., "Application of Antenna Arrays to Mobile Communications, Part II: Beam-Forming and Direction-of-Arrival Considerations," *Proceedings of the IEEE*, vol. 85, No. 8, Aug. 1997, pp. 1195-1245.

Van Veen et al., "Beamforming: A Versatile Approach to Spatial Filtering," *IEEE ASSP Magazine*, Apr. 1988, pp. 4-24.

* cited by examiner

*Primary Examiner*—Dao Phan
(74) *Attorney, Agent, or Firm*—Pillsbury Winthrop Shaw Pittman, LLP

(57) ABSTRACT

An adaptive beam-forming system using hierarchical weight banks for antenna arrays in wireless communication systems is disclosed. The present invention can be applied for both reception and transmission beam-forming. The hierarchical weight banks contain weights that are pre-calculated based on pre-set beam look directions. By comparing measurements of chosen signal quality metrics for pre-set look directions, the best weights, and thus the best beam look direction, can be selected from the weight banks.

41 Claims, 10 Drawing Sheets

The beam direction search resolution = 15°

ADAPTIVE BEAM-FORMING SYSTEM USING HIERARCHICAL WEIGHT BANKS FOR ANTENNA ARRAY IN WIRELESS COMMUNICATION SYSTEM

CROSS REFERENCE TO RELATED APPLICATION

This application claims priority under 35 U.S.C. 119(e) to U.S. Provisional Application No. 60/554,408, filed Mar. 19, 2004, the specification and drawings of which are incorporated herein by reference.

BACKGROUND OF THE INVENTION

1. Field of the Invention

The present invention relates wireless communications systems and, more particularly, to beam-forming technologies and associated methodologies.

2. Description of the Related Art

Antenna array systems with desired beam-patterns have been considered as a solution to improve the spectral efficiency and communication quality for both uplink (mobile-to-base station) and downlink segments (base station-to-mobile) in wireless communication systems. The beam-forming technologies employed with antenna arrays can be a powerful means to increase system capacity, improve quality of service (QoS), reduce co-channel interference (CCI), and multipath fading. Generally, this is because a transmitter/receiver using an antenna array can increase or decrease antenna gain in the intended look directions (i.e., approximate direction of mobile terminal location).

There are several ways to realize such beam-forming technologies. For example, switch beam antenna arrays select a beam pattern out of a set of previously fixed beam patterns, depending on the receiving signal power measurement and spatial location of the desired mobile terminal or base station. Such systems typically comprise multiple antenna elements, a fixed beam-forming network, multiple beam power measurement units, a beam selection unit, and transceiver. For switch beam antenna array, the transmitting/receiving beam is selected by measuring the desired signal power within each beam and selecting the beam having the largest received signal power. The received signal power within each beam may be averaged over the fast fading pattern.

A second example of beam-forming technology is what is employed in dynamically phased array systems. In such systems, the beam pattern is modified based on the look direction of the desired mobile or base station via phase shifter. Dynamically phased array systems typically comprise multiple antenna array elements, multiple phase shifters (one for each antenna element), a weight computation unit and a power combiner. Beam-forming technology using dynamically phased array has the advantages of simple weight calculation which based on the look directions, high directivity and easy implementation. However, the direction of arrival (DOA) of the desired signal needs to be estimated or known a priori in order to adjust the phase shifters and make the beam main lobe point to the target mobile or base station.

A third example of beam-forming technology is what is used in fully adaptive antenna arrays. The adaptive antenna array system typically comprises multiple (M) antenna elements, M RF units, M down converter to convert RF signals into base band signals, M A/D converters, a weight computation unit to generate the beam-forming weights, and a beam-former. Adaptive antenna array beam-forming technology is performed in base-band by using digital signal processing algorithms and the beam-forming weights are calculated according to weight computing algorithms. Several beam-forming weight computing approaches are described in the paper, "Beam-forming: A Versatile Approach to Spatial Filtering", IEEE ASSP Magazine, Vol. April, 1988, pp. 4-24. Also, descriptions of beam-forming approaches using adaptive antenna arrays in wireless communication systems is also available in "Application of Antenna Array to Mobile Communications, Part II: Beam-forming and Direction-of-Arrival Considerations" disclosed in Proceeding of IEEE, Vol. 85, No. 8, August 1997, pp. 1195-1245.

Beam-forming with adaptive antenna arrays, yields maximum SINR (Signal-to-Interference plus Noise Ratio) and an adjustable beam pattern, which allows forming the peaks to the desired signal (S) and nulling of interference signals (I).

Such a system is disclosed in U.S. Pat. No. 6,049,307, which features an adaptive phased antenna array using the weight memory unit to adjust the beam directions. This patent features an adaptive phased array, and the beam direction is scanned by adjusting the amplitudes and phases of received RF signals by using a weight memory unit which stores pre-computed weights (amplitudes and phases of RF signals supplied to each antenna element).

For the application of beam-forming technology in wireless communication systems, a technically and economically feasible method is to use switch beam antenna array where the fix-beams are formed by applying phase shift to the individual antenna elements in the antenna array. Generally, in switched beam-forming technology, one of a set of fixed-beams is selected to the desired mobile or base station based on the best measurement of received signal power. This fixed-beam approach could offer feasible coverage and capacity extension especially in a macro cell environment but the performance of this approach will be degraded in large angle spread or multipath propagation environment.

SUMMARY OF THE INVENTION

It will be appreciated that the beam-forming technologies discussed above suffer from various drawbacks. For example, the beam beam-forming technologies associated with switched beam array systems requires the development of a method of beam selection, in such a way that each mobile or base station can be quickly and accurately switched onto the correct beam that covers the area where the desired mobile and base station is located.

For receiving modes, the mobile terminal/base station must determine which of the present beams should be selected in order to receive the signal from the desired mobile terminal/base station. Similarly, for transmission mode, the mobile terminal/base station must select the suitable beams to transmit the signal to the desired mobile terminal/base station. The cost of producing such a system is proportional the number of look directions that must be supported and can become expensive due to the need for one set of analog hardware for each beam look direction.

For the beam-forming technologies associated with dynamically phased array systems, the direction of arrival (DOA) of the desired signal needs to be estimated or known previously in order to adjust the phase shifters to make the beam main lobe point to the target mobile or base station. This dependence on DOA requires complicated direction finding algorithms and overall system performance hinges on the accuracy of the look direction information and angular spread effect.

Finally, the beam-forming technologies associated with adaptive antenna array systems, require complex weight computing algorithms and powerful DSP processors, which are expensive and consume a great deal of battery power. Also, the adaptive antenna array should be well calibrated. Further, with regard to U.S. Pat. No. 6,049,307, because the amplitude and phase adjusting procedure is carried out on the RF stage with phase shifter and the RF power combiner/feeder/divider are analog components, the application of this technique would be limited cost and size in the wireless communication systems. Also, this technique can not be applied in the multipath propagation environment as the multipath components can not be separated by this technique.

For at least these reasons, the principles of the present invention, as embodied and broadly described herein, provide for the present invention is directed to providing an adaptive antenna array system for a wireless communication system that employs a beam-forming network having a set of hierarchical weight banks to suppress interference and background noise and to improve system performance, such as SINR (Signal-to-Interference plus Noise Ratio) and BER (Bit Error Rate), within a single-path or multipath propagation environment.

In one embodiment, the present invention provides a wireless communication system, comprising an antenna array structure having a plurality of antenna elements that receive and transmit radio-frequency signals, one or more radio-frequency units and frequency converters configured to transform received RF signals to receive analog base-band signals and transform analog transmit base-band signals into a transmit RF signals, one or more analog-to-digital converters configured to convert the receive analog base-band signals into a receive digital base-band signals and one or more digital-to-analog converters configured to convert transmit digital base-band signals into transmit analog base-band signals. The wireless communication system further comprises a multipath delay profile estimation unit configured to estimate delays of multipath signal components based on the receive digital base-band signals, and a plurality of beam-forming units configured to process the multipath signal components. Each of the beam-forming units comprise a set of hierarchical weight banks that store pre-calculated weights in accordance with pre-specified beam look directions, a digital processing unit configured to estimate a signal metric, select the best weights from weight banks based on the estimated signal metric, and apply the selected weights to the received and/or transmitted signal to shift a beam pattern to point to the best beam look direction.

The present invention is different from prior art as the beam-forming procedure is performed entirely in the digital base band using digital signal processing algorithms. The present invention has more flexibility than that of the fixed beam switch approach as the present invention implements digital beam-forming that can be implemented with software defined technology which reduces analog hardware costs and is more easily adapted and portable to different wireless systems.

In the present invention, by using multiple beam-forming units and based on the look directions of a desired signal and digitally tuning the beam based on the best measurement of quality metric for the received signal such as instant signal power, SINR or BER, and with a set of pre-calculated weight banks, the beam-former performance would be improved in angle spread and multipath propagation environments.

The pre-calculated hierarchical weight banks are computed a priori based on data-independent beam-forming technology which uses pre-set look directions and array steering vector as beam-forming weights to provide the generated beams with high directivity and high resolution. The present invention does not require the pre-set look directions to be absolute directions from a fixed reference. Rather, the pre-set look directions must only be set at some known interval and known offset angle from adjacent look directions. Thus, the present invention does not require any absolute direction-of-arrival (DOA) information to be calculated in order to perform beam steering.

The pre-calculated hierarchical weight banks consist of weights that define beams for pre-set look directions. In the case of a planar field, for example, the azimuth can be divided into pre-set look directions. For each look direction there exists a set of weights that defines a beam, which is centered on that look direction. These weights are stored in one or more tiers of weight banks, which cover all pre-set look directions. The weights are applied to the signal to create a beam pattern pointing to a specific look direction.

When the present invention is used in a receiver, weights for different look directions can be applied to all or part of a received signal and the quality of the resulting signal from each beam can be compared so as to effectively search for the look direction that yields the highest signal quality. "Signal quality" may be defined as any desired signal attribute such as instant power of the received signal or SINR of the received signal, for example. The signal quality metric that is used will depend on the specific application for which the present invention is being used. Once the best look direction is determined, the optimal weights are applied to the entire received signal. With this beam-forming procedure, the SINR and BER of a received signal can be improved. In a wireless network, an improvement in SINR yields great benefits such as increased network capacity, extended coverage and lower bit-error-rates (BER).

For multipath environments, multiple beam-forming units can be used to collect the multipath signal components if multipath components are collected by different beams.

The processing time for the present invention is proportional to the number of pre-set look directions. In order to support more efficient algorithms to search for the best look direction, the weights are stored in hierarchical weight banks. An efficient look direction searching and weights selection scheme, using a binary tree structure, is presented in the detailed description of the present invention. Other structures may also be used for the weight banks. The present invention is not limited to any one particular weight bank structure.

For uniform linear antenna arrays, the mirror beam can be used to further reduce beam direction searching time when the coverage of beam direction search is greater than 180 degree.

When an antenna array containing parasitic antenna elements is employed, there is at least one active antenna element connected to a radio-frequency unit, which includes a frequency converter configured to transform received RF signals to receive analog base-band signals and transform analog transmit base-band signals into transmit RF signals, one or more analog-to-digital converters configured to convert the received analog base-band signals into base-band signals, and one or more digital-to-analog converters configured to convert transmit digital base-band signals into transmit analog base-band signals. In addition to the active element(s), the parasitic antenna array may also include a plurality of parasitic antenna elements, each of which connects to either an adjustable passive impedance component or directly to electrical ground.

In the present invention, the adaptive beam-forming system is based on the measurement of a signal quality metric with pre-set look directions and selection of the corresponding set of pre-calculated weights to beam-form to the desired look direction.

The present invention offers a significant improvement over prior art in that there is no calibration required for the antenna array. By eliminating the need for calibration, the present invention reduces manufacturing costs and component costs for devices employing beam-forming technology.

For transmission beam-forming, information from the receiver beam-forming process can be used to determine the best look direction for the transmission beam. For example, the transmitter may transmit in the same direction as the best receiver look direction. This is especially useful for wireless communication systems using time-division-duplex (TDD) mode of operation where uplink and downlink channels use the same frequency. This technique may also be used for frequency-division-duplex (FDD) wireless communication systems. In the presence of received multipath signals, transmission weights can be selected from the same weight bank based on the received multipath component with the best signal quality (i.e. transmit only in the direction of the best received multipath component).

In the present invention, the reception adaptive beam-forming system based on the hierarchical weight banks includes an antenna array system where a plurality of antenna elements are structured as a linear array, a circular array, or any other two-dimensional or three-dimensional structure. The antenna elements may be omni-directional, sectored (directional), or a combination of omni-directional and sectored antennas. Further, the antenna elements may be "active" (i.e. connected to an RF receiver chain), or "parasitic" (i.e. connected to an adjustable passive impedance component or directly to electrical ground).

One or more RF units and down converters are used to transform RF signals into base band signals and are connected to one or a plurality of A/D converter units, which convert the analog base band signals into digital signals. An electronically-controlled switch may be employed to multiplex signals from multiple antenna elements through a single RF chain, thereby enabling multiple active antenna elements to share a single RF chain.

A multipath delay profile estimation unit is then used to estimate the delay profiles for each multipath component, separate the multipath components in the temporal domain and distribute these multipath signal components to multiple beam-forming units. The multipath delay profile estimation unit detects multipath components received by the antenna array and separates the corresponding multipath components. For example, if two multipath components are received while using a three antenna array, the multipath delay profile estimation unit should identify a total two components and result in six outputs (i.e. two multipath signals from each of the three antennas). The corresponding multipath components from each antenna are correlated and forwarded to the beam-forming units. The number of beam-forming units employed is equal to the number of multipath components received. Each beam-forming unit accepts a number of input signals equal to the number of antenna elements in the array.

Each beam-forming unit applies weights to its input signals in order to implement the beam-forming and determine the set of weights that yields the best output signal quality. Each beam-forming unit outputs one and only one signal.

If multiple beam-forming units are employed (i.e. in a multipath environment), a Maximum Ratio Combiner can be used to combine the output signals from the different beam-forming units.

The apparatus for the reception adaptive beam-forming system based on the hierarchical weight banks include a plurality of antenna elements spaced in specific structure (e.g. linear, circular, etc.), a multipath delay profile estimation unit which estimates the delay of multipath components and distributes the multipath components to the beam-forming units, a set of hierarchical weight banks which are computed off-line and pre-stored in some form of memory (e.g. Read-only Memory, Flash Memory, Random Access Memory, EPROM, etc.), and one or more receiver beam-forming units, which evaluate the quality of a received signal in various beam-formed look directions, determine the best look direction for each received multipath component of the signal and apply the appropriate weights associated with each look direction separately to each received multipath component and performs a weighted sum of the signals received from each antenna element. A Maximum Ratio Combiner may be used to combine multiple output multipath signal components from the beam-forming units in the case where multiple beam-forming units are employed.

In another embodiment of the present invention, a transmission beam-forming system for use in a wireless communication system is described. The transmission beam-forming system includes an antenna array system and a plurality of RF units which may be shared with the receiver beam-forming system, a plurality of up-converters which transform base-band signals into RF signals, a plurality of digital-to-analog (D/A) conversion units which convert the digital signals to analog signals, and a transmit beam-forming unit.

In the transmit beam-forming unit, the multipath selection unit is used to select the best path from received multipath components based on the received signal quality metric. The weight selection unit uses the same set of weights as the receiver beam-forming units and applies these weights for transmission beam-forming. In the case where multiple signal paths were received (i.e. multipath), the transmission beam-forming unit may employ only the set of weights associated with the best received path, based on the received signal quality metric, and then apply that single set of weights to the transmitted signal. Transmitting only in the same direction as the best received multipath component is a simplification of the transmission beam-forming but may be desirable to simplify system designs, reduce production costs and reduce component costs.

BRIEF DESCRIPTION OF DRAWINGS

Embodiments of the invention will now be described, by way of example only, with reference to the accompanying schematic drawings in which.

In the Figures, corresponding reference symbols indicate corresponding parts.

DETAILED DESCRIPTION OF THE INVENTION

The present invention provides a wireless communication system employing an adaptive beam-forming network that utilizes hierarchical weight banks. It will be appreciated that such a system may be employed at either a base station or mobile terminal, or both.

Figure 1:
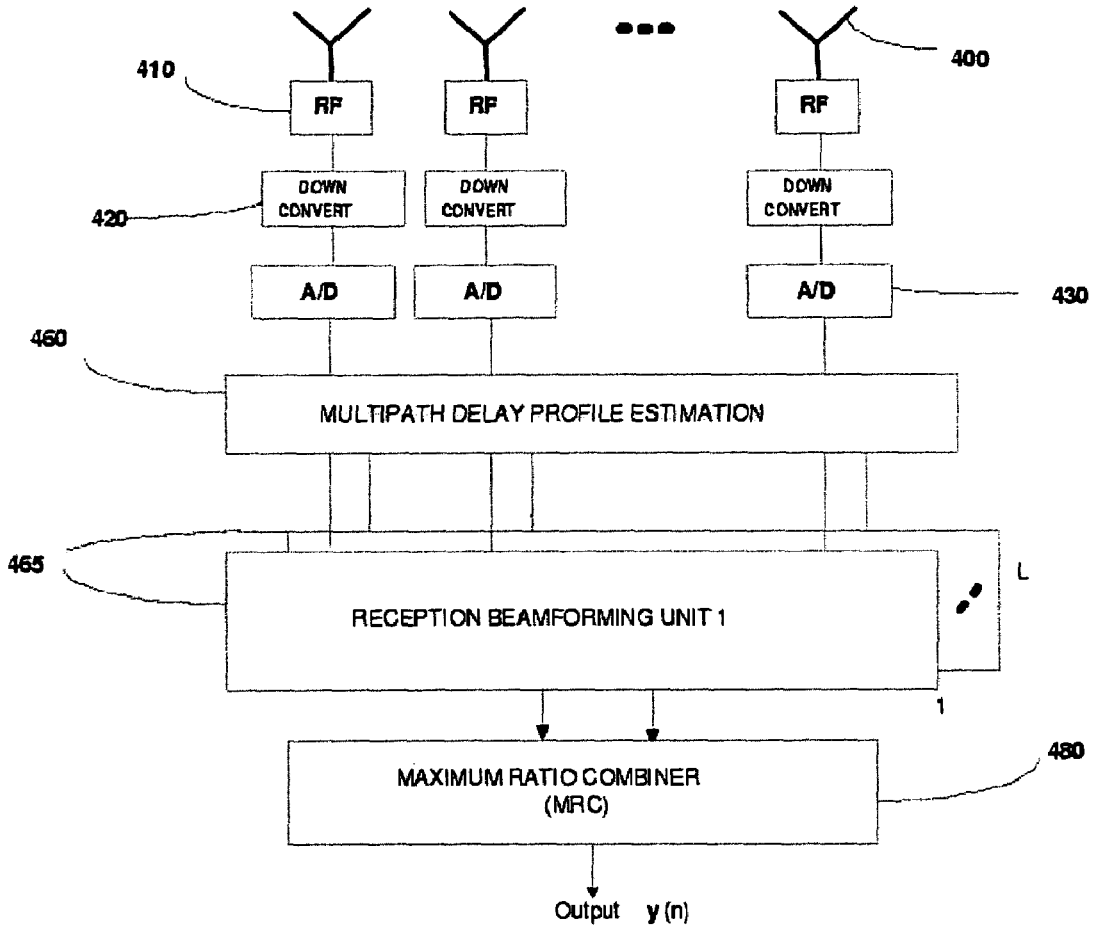
FIG. 1 depicts a receiver beam-forming system, in accordance with an embodiment of the present invention.

FIG. 1 schematically depicts a receiver beam-forming system, in accordance with an embodiment of the present invention. The system comprises an antenna array with M antenna elements 400. These antenna elements may be configured as omni-directional, sectorized, or a combination of omni-directional and sectorized elements.

The antenna array feeds into a plurality of RF units 410 and down converters 420, and then converted into digital signals by A/D units 430. The M output digital signals from A/D converters are fed into a multipath delay profile estimation unit 460.

To enhance performance in a multipath propagation environment, the multipath delay profile estimation unit 460 is used to distinguish the multipath signals and distribute the multipath signals to the beam-forming units 465. The delay profile estimation unit 460 is configured to distinguish the multipath components, separate the multipath components in temporal domain, as well as distribute these multipath signal components to different beam-forming units 465, labeled as 1, 2, . . . , L.

The beam-forming units operate in the digital domain with digital signal processing algorithms. The Maximum Ratio Combiner 480 is used to combine the output signals from the beam-forming units. In a multipath environment, all L multipath components may be combined to yield a robust, high SINR output signal.

For the multipath delay profile estimation 460 in the present invention, the approaches used for delay estimation may be different as they are system-specific. For example, in a CDMA system, the multipath delays can be estimated by using a code correlator to distinguish the delays for each multipath component and to separate the multipath signal components in the temporal domain. These multipath signal components are distributed to the multiple beam-forming units and combined by a combiner mechanism 480, such as a Maximum Ratio Combining (MRC) unit after beam-forming.

As noted above, receiver beam-forming system comprises a plurality L of beam-forming units in order to process at least L of multipath components. One beam-forming unit is assigned for each distinct multipath component. In a multipath environment, the multipath components often arrive at the receiver from different directions. Each beam-forming unit determines the best beam look direction for its assigned multipath component. In this way, the present invention enables a separate beam to be focused on each multipath component, thereby maximizing the received signal quality of each multipath component.

Each of the beam-forming units references a set of weight banks to determine the best look direction weights for its assigned multipath component. The best look direction for receiving each desired signal can be determined by measuring a quality metric, such as, for example, instant power, SINR, frame error rate, bit error rate, or any other metric, for each pre-set beam look direction.

A directional beam is then formed by applying a pre-calculated set of weights to the received signals. These pre-calculated weights are computed for various different look directions. The exact direction and spacing between the look directions depends on the direction search resolution and the azimuth of the desired region to be searched.

For the weight computation in the present invention, a data-independent method which uses pre-set look directions and array steering vector as beam-forming weights provides the generated beams with high directivity and high resolution. In general, data-independent methods do not require any information about the received or transmitted signals to calculate the beam-forming weights. A detailed description of data-independent methods can be found in the paper, "Beam-forming: A Versatile Approach to Spatial Filtering", IEEE ASSP Magazine, Vol. April, 1988, pp. 4-24. In hierarchical weight banks, the pre-calculated weight vector may be computed off-line for the direction $\theta_i$ as:

$$w(\theta_i) = \frac{1}{M} a(\theta_i)$$

where M is the number of antenna elements, $a(\theta_i)$ is the array steering vector, which is the function of the direction $\theta_i$. For the different array structure, $a(\theta_i)$ will be different, e.g. for the linear antenna array:

$$a(\theta_i)=[1\ \exp(-j\cdot 2\cdot\pi\cdot d/\lambda\cdot\cos\theta_i)\ \ldots\ \exp(-j\cdot 2\cdot\pi\cdot d/\lambda\cdot(M-1)\cdot\cos\theta_i)]^T$$

where d is the interval of the elements, $\lambda$ is the signal wavelength. The direction $\theta_i$ is selected from the tree-type beam direction search scheme for the different tiers in hierarchical weight banks.

In order to facilitate efficient searching, the weights for each receiver look direction may be stored in a hierarchical structure, such as a binary tree or B+ tree structure. In such a configuration, the first tier of weight banks consist of weights for look directions that are spaced apart such that the entire search azimuth can be covered. The number of look directions in the first tier weight bank and the spacing of these look direction may be determined by the Rayleigh limitation for the number of antennas and antenna structure being employed.

The beam direction searching scheme is started by measuring the quality metric from each look direction in the first tier weight bank. This process effectively divides the entire search azimuth into sectors. After comparing the signal quality metric, the vicinity of possible mobile terminal or base station locations can be selected and the weight selection unit will refine the direction search pattern with the next tier weight bank until the best look location with best signal quality and corresponding best weights are found.

This tree-type search scheme with hierarchical weight banks is capable of finding the best possible look direction of the desired signal efficiently and therefore save processing time. With this scheme and applying the best weight to the received signal, the beam-forming unit will make the best beam shift to the desired signal.

If multiple beam-forming units are deployed, several best beams can be combined by signal combiner, such as, for example, a Maximum Ratio Combiner. This provides the flexibility to deal with beam hand-over scenarios as well as multipath propagation environments. The output signal from combiner is a high SINR (Signal-to-Interference plus Noise) signal and used for the decoding.

Figure 2:
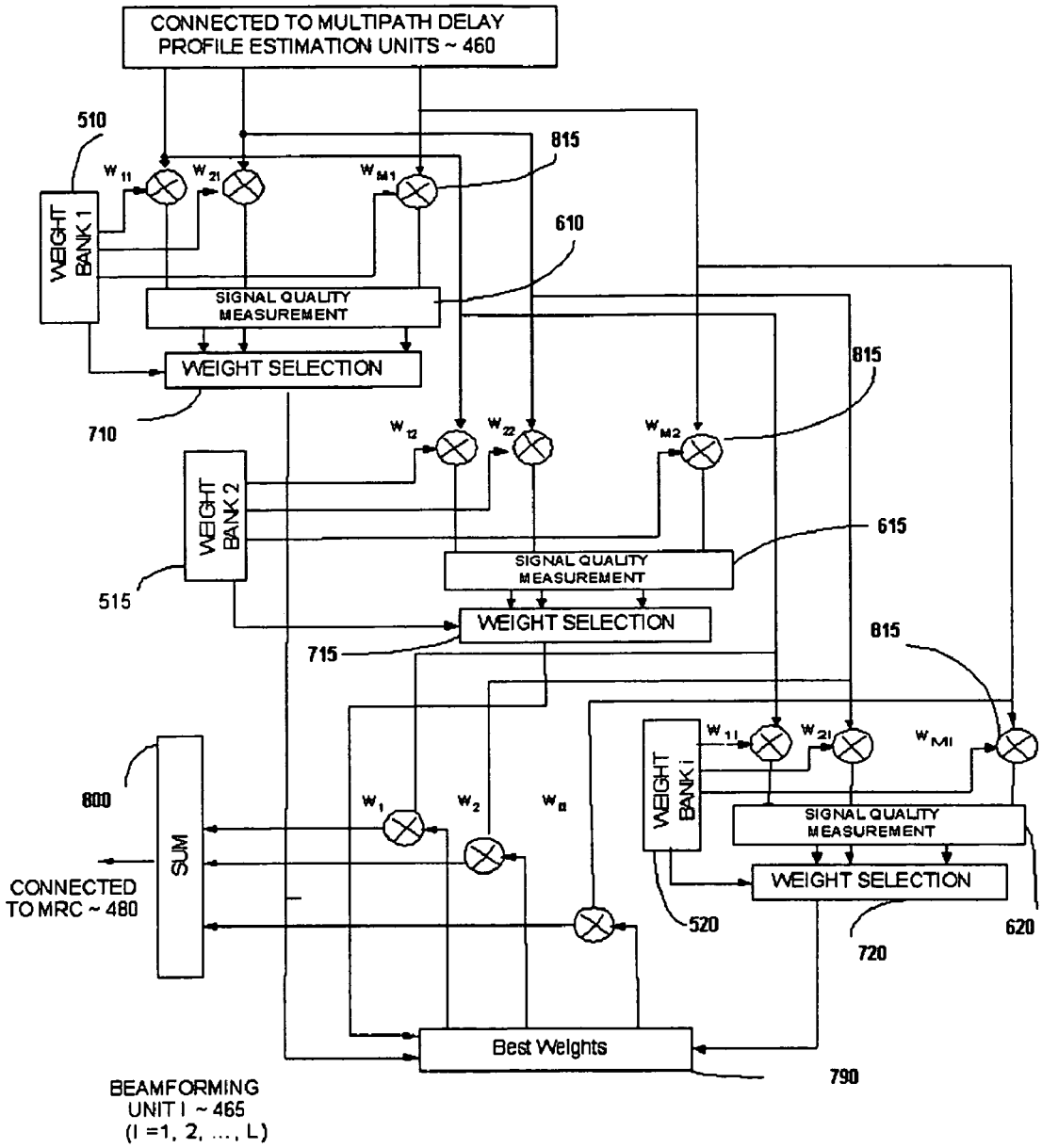
FIG. 2 illustrates a receiver beam-forming unit, in accordance with an embodiment of the present invention.

FIG. 2 depicts a detailed schematic diagram of a beam-forming unit 465, in accordance with the present invention. For each beam-forming unit, M input digital signals are derived from the multipath delay profile estimation unit 460. The tree-type beam direction search scheme with hierarchical weight banks, labeled as 1, 2, . . . , K, is used to determine the best weights.

In the first tier search, the weights in weight bank 1 are applied to the input signals with multipliers 815, in which the output of this multiplication operation can be used for the signal quality by signal quality measurement unit 610. The outputs of signal quality measurement unit 610 are then compared to select the best look direction and based on this direction, the weight selection unit 710 will select the possible vicinity of the desired signal.

Once the vicinity is determined, weight bank 2 is used to refine the beam direction search. This refined beam direction searching will be continued until the best signal quality direction and corresponding best weights are found. After finding the best weights, the input signals from different antenna elements will be multiplied by the best weights and summed to generate the output signal of the beam-forming unit.

Figure 3:
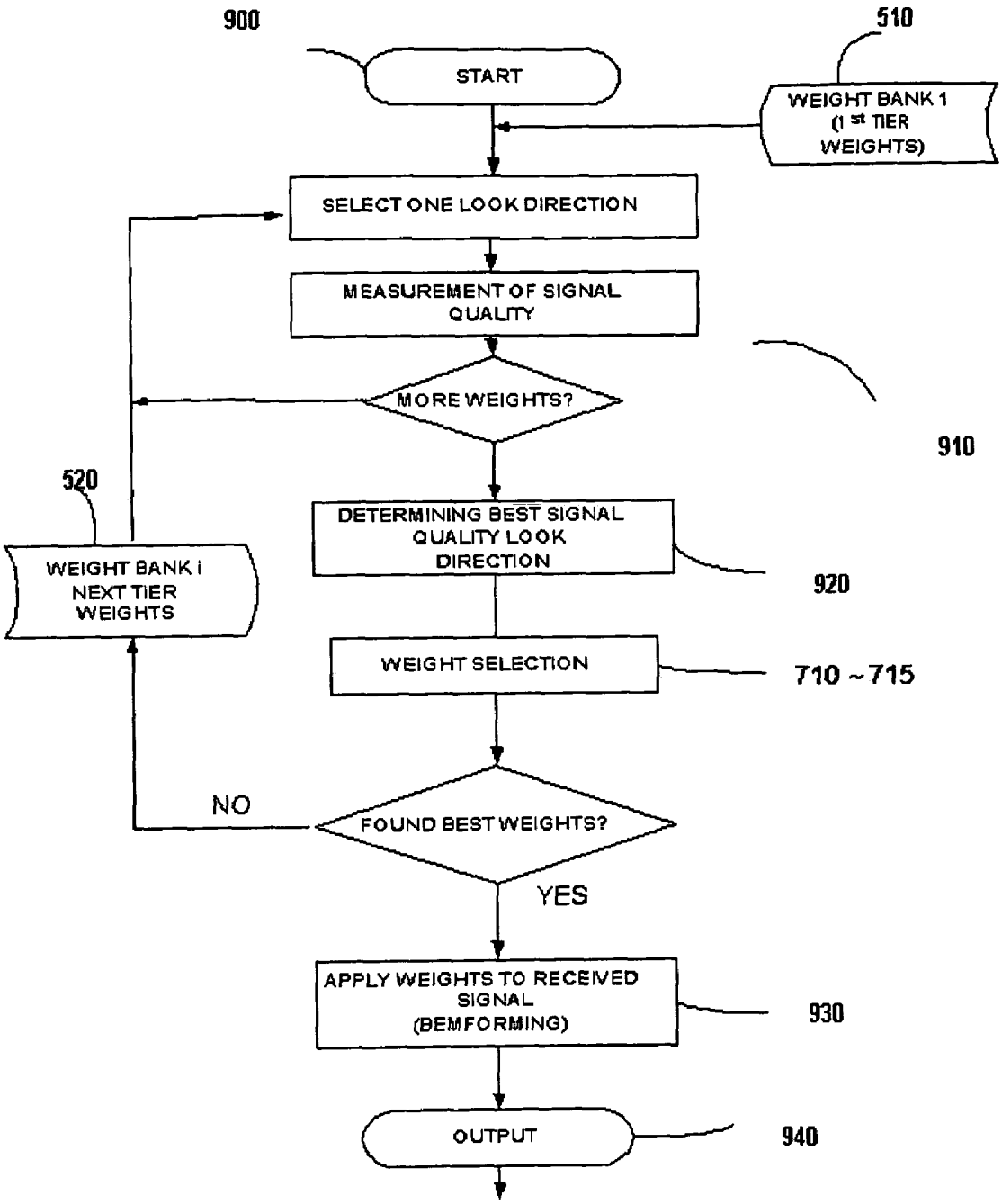
FIG. 3 provides a flow chart for the search process to determine the set of weights associated with the best receiver look direction, in accordance with an embodiment of the present invention.

FIG. 3 provides a flow chart for the beam-forming procedure according to the present invention. When the antenna array system is started 900, the weights stored in the first weight bank 510 will be applied to the received signals and shift the beams to the pre-set beam look directions. This is the initial beam direction search 910.

By comparing the instant signal powers, or any other metric, from these pre-set beam directions, the best beam direction can be determined 920, indicating the possible vicinity of the desired signal. In this example, the weight selection units 710~720 will select corresponding weights for the beam direction of best signal quality. During this task, the weights for the pre-set beam direction neighboring the maximum power beam direction are also selected and the corresponding signal quality metrics are compared.

If the neighboring direction power is greater, which means the selected weights are not best weights, the weights stored in the second weight bank (or the $i^{th}$ weight bank, where i=1,2 , . . . , K) with smaller pre-set beam direction grid will be applied and beam direction search will be repeated.

This procedure will be repeated until the weights for the best signal quality beam direction are found. Once the best weights are found, these weights are multiplied with the received signals and then summed 930 to generate the output signal beam-forming process 940 to the Maximum Ratio Combiner 480.

In the present invention, the weights in the hierarchical weight banks are pre-calculated for the specific pre-set look directions, which depend on the beam direction resolution and binary tree-type beam direction search scheme. For pre-set look direction design, the azimuth may be divided by pre-set look directions and the I tier weight banks should cover all pre-set look directions. The pre-set look direction can be computed with the array searching azimuth θ, null to null beam width $BW_{n\text{-}n}$ (Rayleigh resolution limit) which is decided by array aperture, and the half beam width BW. In particular, for half wavelength spaced uniform linear array:

$$BW_{n\text{-}n}=2\sin^{-1}(2/M)\text{ degree; and}$$

$$BW=2\sin^{-1}(0.891/M)\text{ degree}$$

where M is the number of antenna elements.

The number of pre-set look directions in different tier weight banks may be different. For the pre-set look directions in the first tier weight bank, the number of pre-set look direction will be:

$$N1=\theta/\text{sector width}$$

where sector width=$BW_{n\text{-}n}$—overlap angle. The overlap angle represents the overlap part of two beams. For the sequence weight banks, the number of pre-set look directions within the each sector will be:

$$Ns=\text{sector width}/BW$$

The number of tiers of binary tree for weight banks will be:

$$K=\log_2(Ns)$$

The total searching times for the look directions will be:

$$N=N1+2K$$

Figure 4:
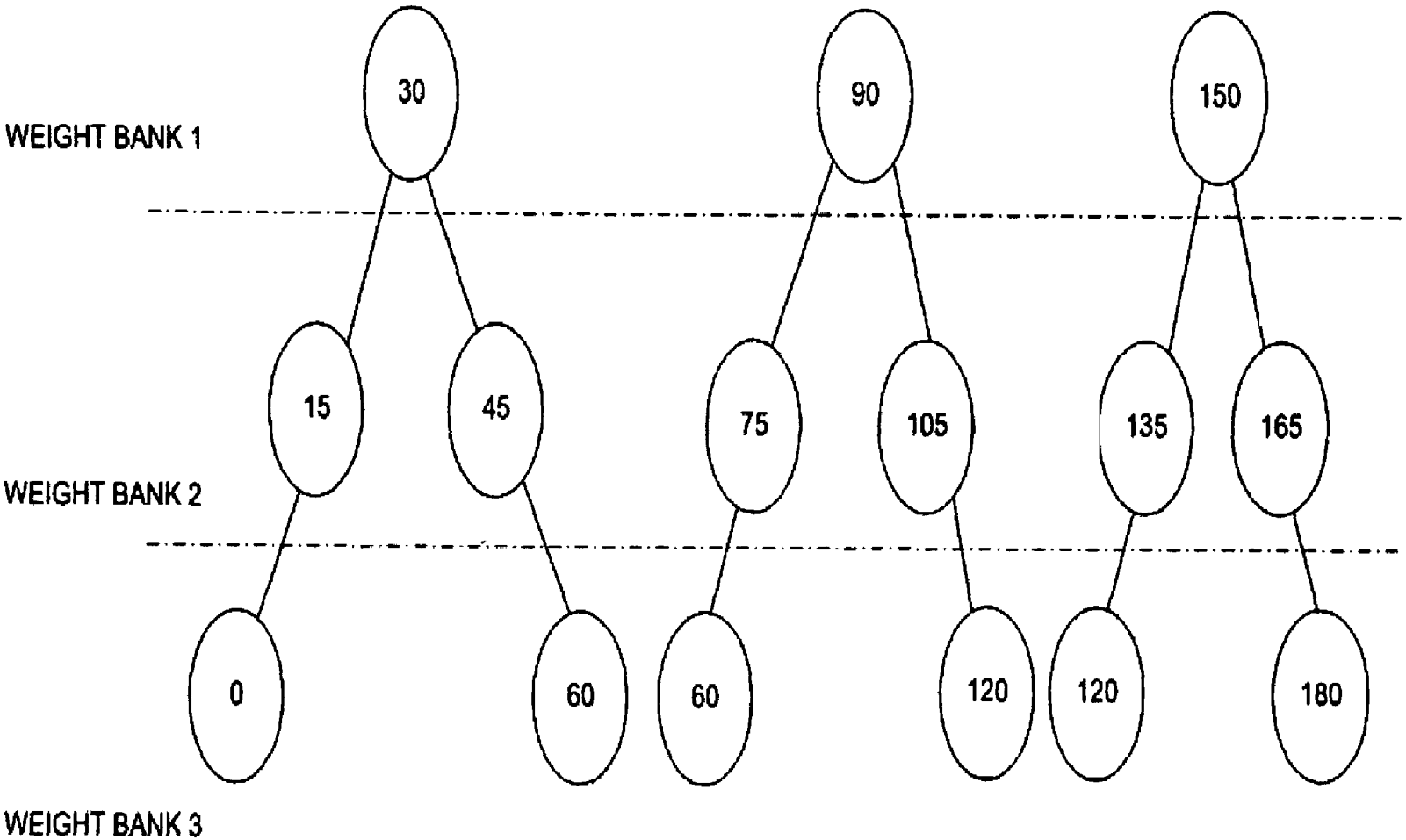
FIG. 4 depicts a hierarchical weight bank structure based on a binary tree, in accordance with an embodiment of the present invention.
Figure 5:
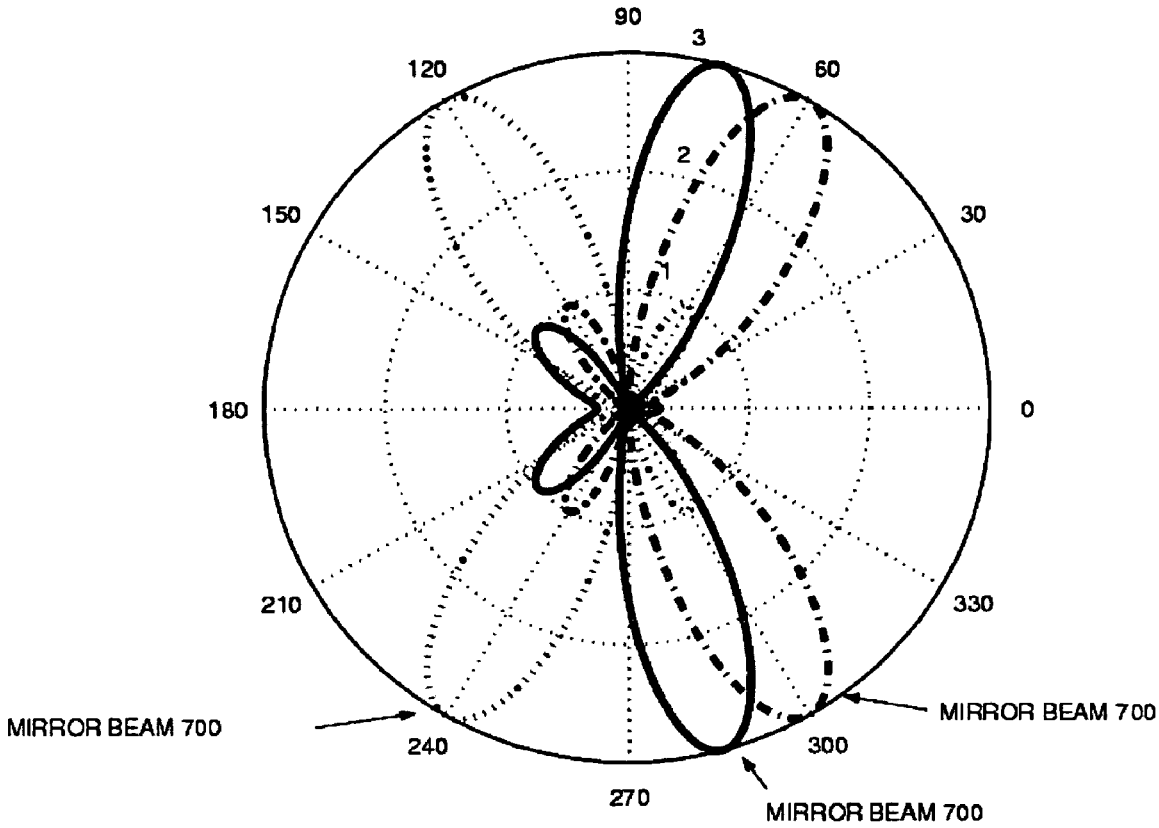
FIG. 5 illustrates beam pattern for the mirror beam generated by various look directions of a uniform linear antenna array, in accordance with an embodiment of the present invention.

FIG. 4 provides an example for the binary tree-type beam direction search scheme with 3 tiers where the beam direction resolution is 15 degree. The weights in the first weight bank will be calculated for the look directions of 30 degrees, 90 degrees and 150 degrees.

The second weight bank will be calculated with refine direction grids as 15 degrees, 45 degrees, 75 degrees, 105 degrees, 135 degrees and 165 degrees and the third weight bank will be 0 degrees, 60 degrees, 120 degrees, and 180 degrees.

In third weight bank, as the look directions of 30 degrees, 90 degrees and 150 degrees have been checked in the previous weight banks, the weights for these look directions can be removed from the third weight bank. With signal quality measurement unit (610~620), the best signal quality beam direction for each tier can be found by searching the hierarchical weight banks. For a linear antenna array, the mirror beam directions can be used to expedite searching an azimuth greater than 180 degrees.

In the present invention, the signal quality should be measured to find the best look direction within the different tiers. For the antenna array shown in FIG. 2, composed of M antenna elements, assumed that P desired signals and interference signals are impinging on the array, each with L multipaths. The received signal vector can be represented as:

$$x(n) = \sum_{p=1}^{P}\sum_{l=1}^{L} A(\theta_p)s(n) + v(n)$$

$$= \sum_{l=1}^{L} [\, a(\theta_{1l}) \quad a(\theta_{2l}) \ldots a(\theta_{Pl}) \,]s(n) + v(n)$$

where x(n) is the received signal plus interference vector, A(θ) is the steering matrix, which includes the information for the direction of arrival (DOA, θ) of the desired signal and interferences, $a(\theta_{pl})=[\alpha_1(\theta_{pl})\ a_2(\theta_{pl}) \ldots {}_M(\theta_{pl})]^T$ is the array steering vector, s(n) is signal and interference vector, v(n) is additive Gaussian white noise vector, P is the number of received signal and interferences and n is the signal sample index.

For the real-time signal power estimation, the estimation of signal vector ŝ(n) can be calculated for the different directions as:

$$\hat{s}(n)=a(\theta_1)^+x(n)$$

where $(\cdot)^+$ denotes the pseudo-inverse operation.

The estimation of instant power can be computed as:

$$\hat{P}_s = \frac{1}{N}\sum_{n=1}^{N} \hat{s}(n)^H \hat{s}(n)$$

where $(\cdot)^H$ denotes the conjugate transpose operation and N is the data length.

The present invention provides a robust weight computation and beam-forming approach, which is based on preset look directions and the measurement of best signal quality. Therefore, the array calibration is not necessary for the present invention. To achieve better beam-forming performance, the antenna array can be calibrated and the beam-forming weights can be computed and stored in the weight banks.

Figure 6:
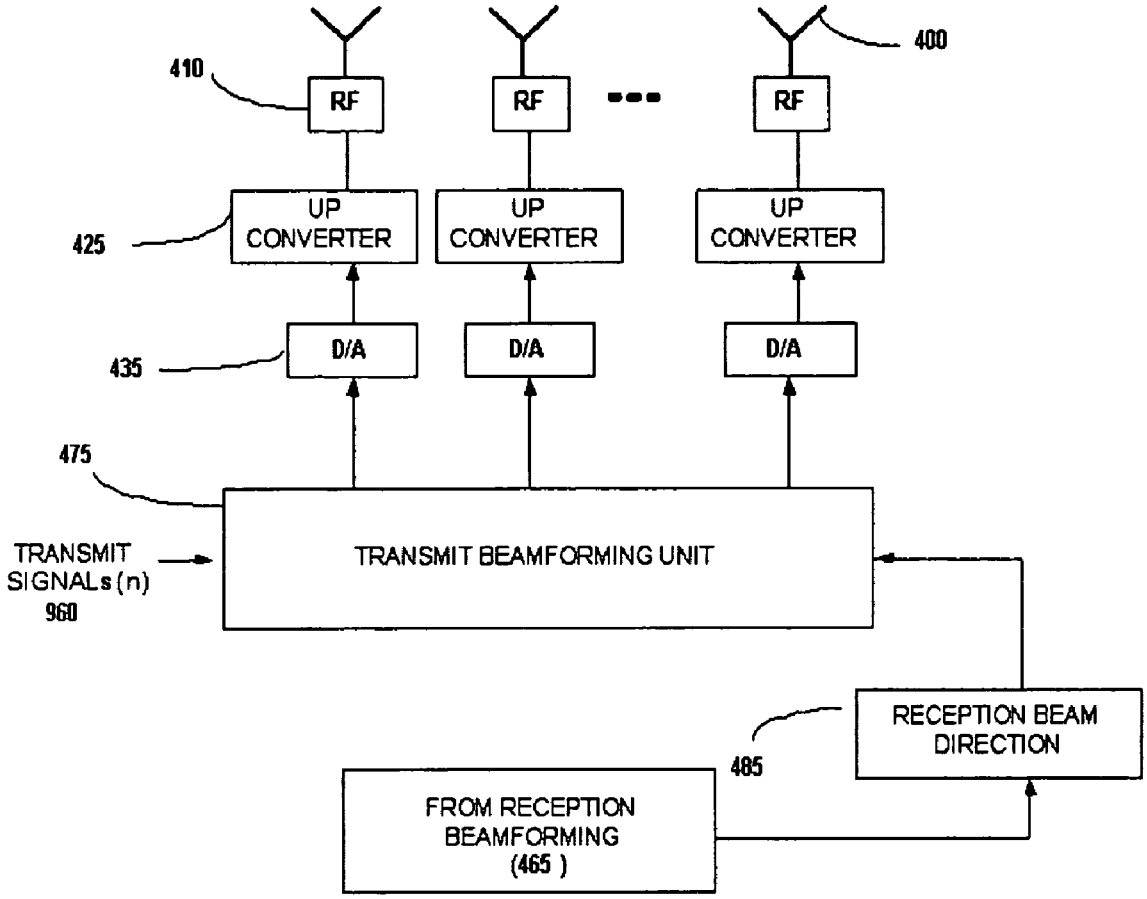
FIG. 6 depicts a transmission beam-forming system for an antenna array in a wireless system, in accordance with an embodiment of the present invention.

FIG. 6 schematically depicts transmission beam-forming system, in accordance with the present invention. For transmission beam-forming, the transmission weights can be selected from the same reception weight bank based on the measurement of best received signal quality. For the case of L multipaths, the transmission weights will be the same as the reception beam-forming weights for the best path(s) from weight banks and the signal will be transmitted via that path(s).

Figure 7:
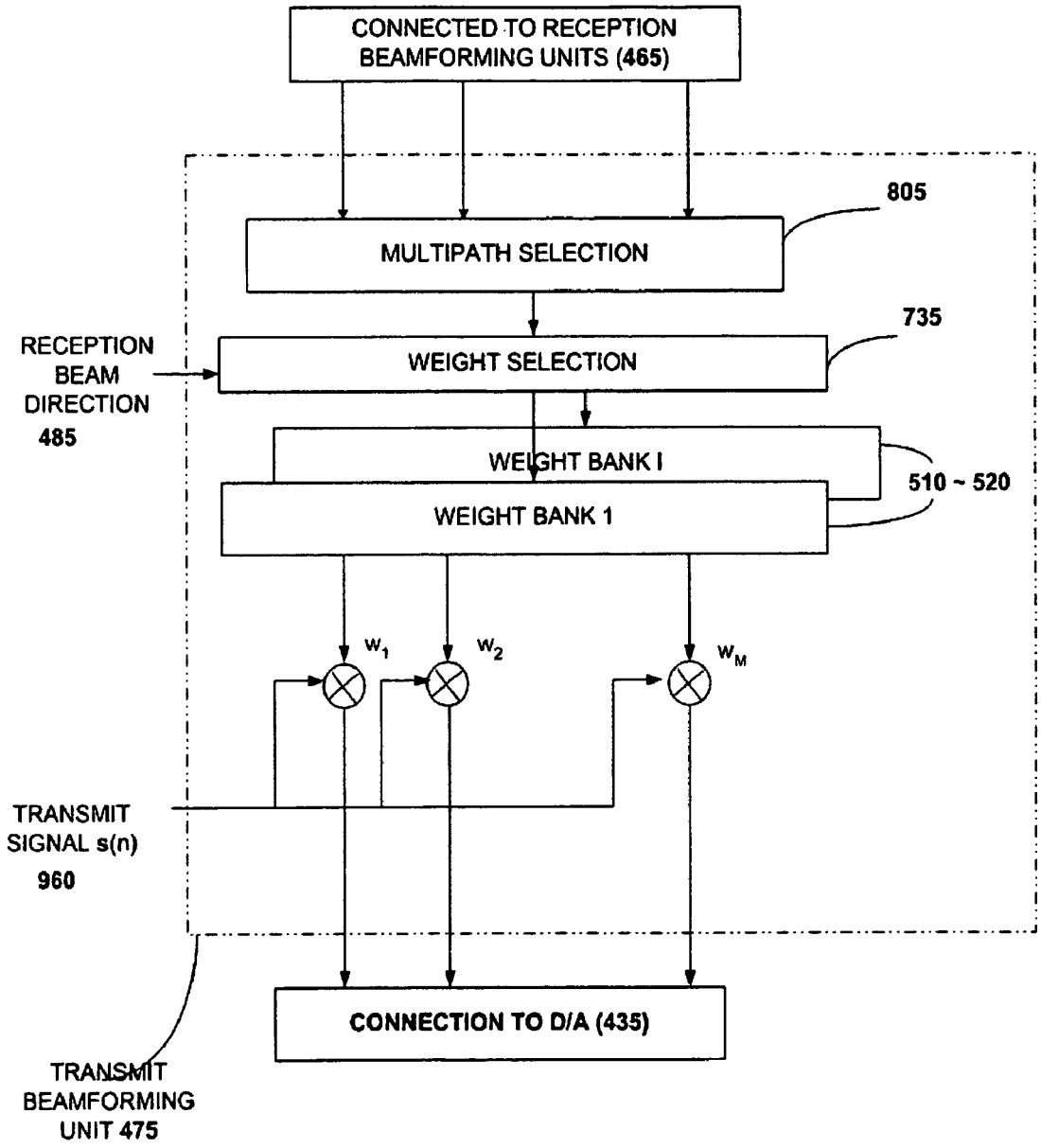
FIG. 7 illustrates a transmission beam-forming unit, in accordance with an embodiment of the present invention.

FIG. 7 shows the detail schematic diagram for the transmit beam-forming unit where the best path can be selected by the multipath selection unit (805) based on the received multipath components. The corresponding transmission beam-forming weights can be the same weights as the reception beam-forming weights for that path and transmit the signal in that direction.

Figure 8:
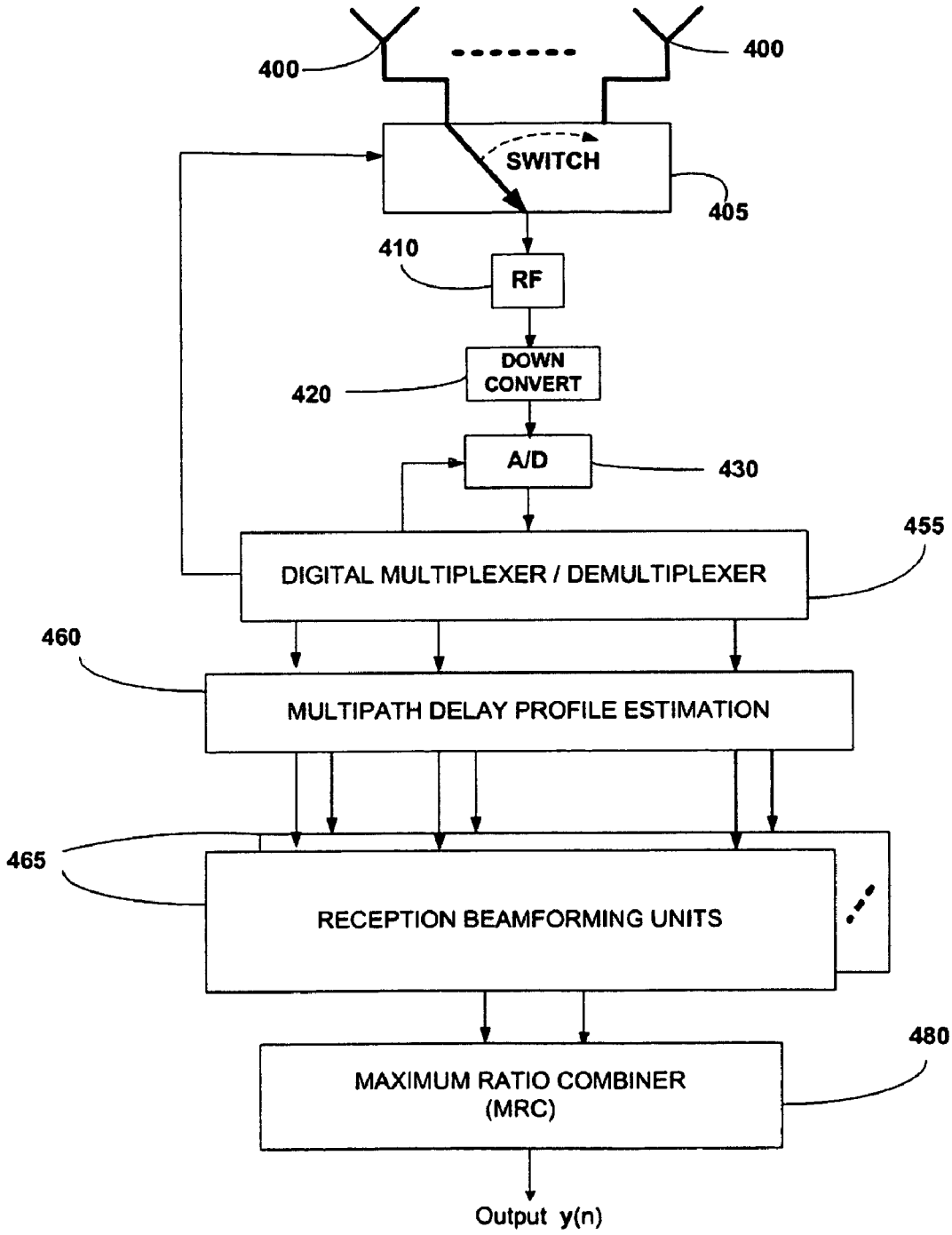
FIG. 8 depicts single RF receiver beam-forming system in accordance with an embodiment of the present invention.

FIG. 8 depicts an embodiment of the present invention that employs an electronic switch 405 to time-division multiplex signals from a plurality of antenna elements 400 through a single RF receiver 410, a single down converter 420, and one or more analog-to-digital (A/D) converters 430. In this embodiment, the electronic switch 405 is controlled by a digital multiplexer/demultiplexer 455 to control connectivity between the antenna elements 400 and the RF unit 410. The digital multiplexer/demultiplexer 455 also controls the sample clock of the analog-to-digital converter(s) 430 to ensure that the sampling operation is synchronized in time with the switching between antenna elements.

After the received signals are converted into digital signals, the received serial digital data stream from each A/D converter 430 is demultiplexed by the digital multiplexer/demultiplexer 455 and the resulting discrete digital data streams corresponding to each antenna element are sent to the multipath profile estimation unit 460. The multipath estimation mechanism and beam-forming mechanisms for this embodiment operate in the same manner as described above regarding the other embodiments, where the antenna elements are each connected to separate RF receivers without using a switch to multiplex the received signals.

Figure 9:
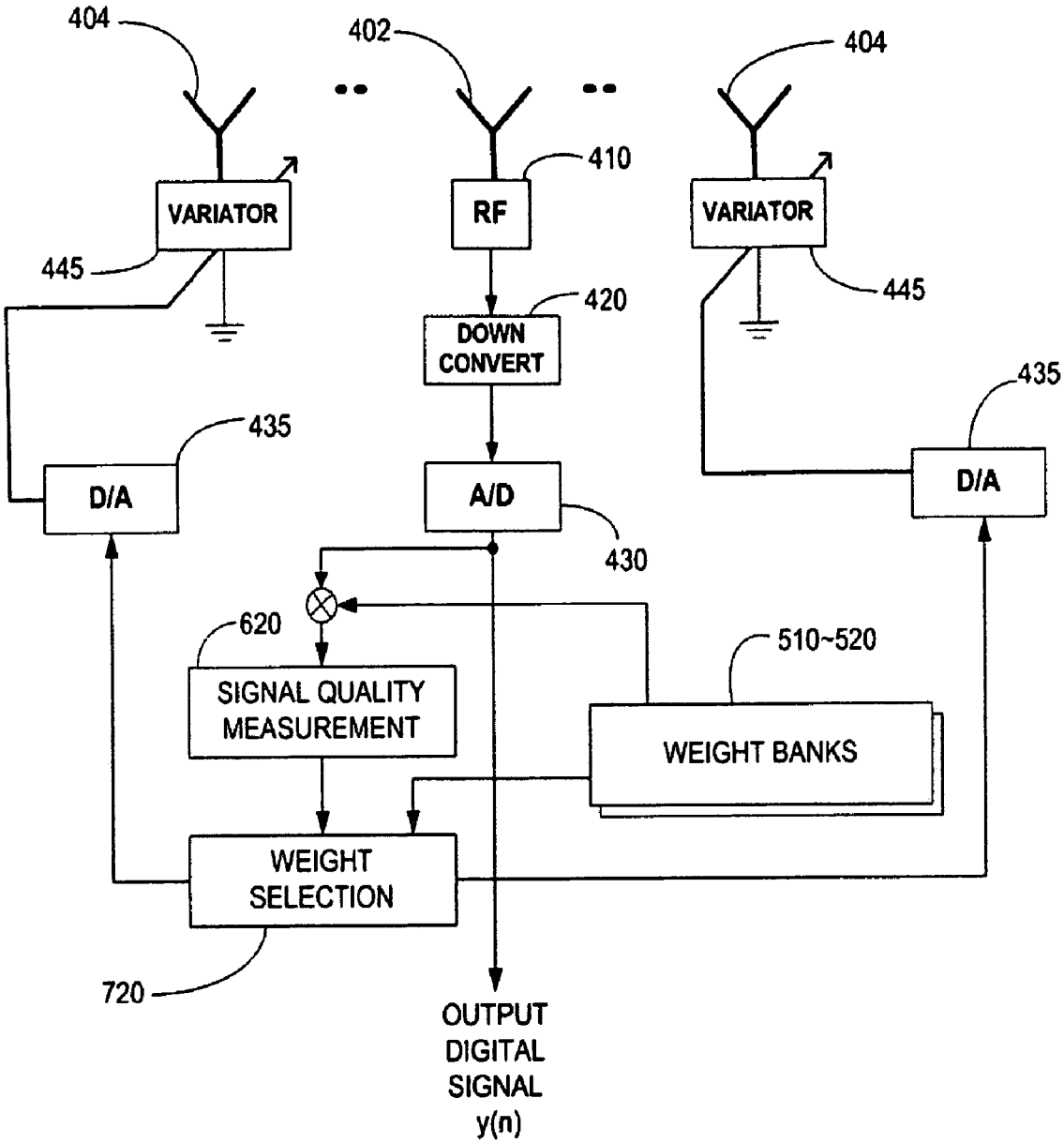
FIG. 9 illustrates a reception beam-forming system using an antenna array containing one or more parasitic antenna elements, in accordance with an embodiment of the present invention.

FIG. 9 depicts another embodiment of the present invention, in which reception beam-forming is performed in the RF domain by utilizing an antenna array which contains one or more parasitic antenna elements. As shown in FIG. 9, one or more active antenna elements 402 are connected with one or more RF units 410, and one or more parasitic antenna elements 404 are connected to variators which are grounded. In accordance with the embodiment, the signal quality measurement unit 620 measures received signal quality and passes this information to the weight selection unit 720, which selects the best weights from the weight banks 520.

Once the best weights have been determined by the weight selection unit 720, digital-to-analog (D/A) converters 435 are used to convert the digitally stored weights into analog signals, which are input into adjustable passive impedance components, such as, for example, variators 445 that are coupled to the parasitic antenna elements 404. In this way, the impedance of the variators 445 can be adjusted to affect the electromagnetic field of the parasitic antenna elements 404. By adjusting the electromagnetic fields of the parasitic elements 404, the beam pattern of the active antenna elements 402 can be manipulated so as to steer the antenna pattern toward a desired look direction. It will be appreciated that some of the parasitic antenna elements may also be directly connected to electrical ground.

Figure 10:
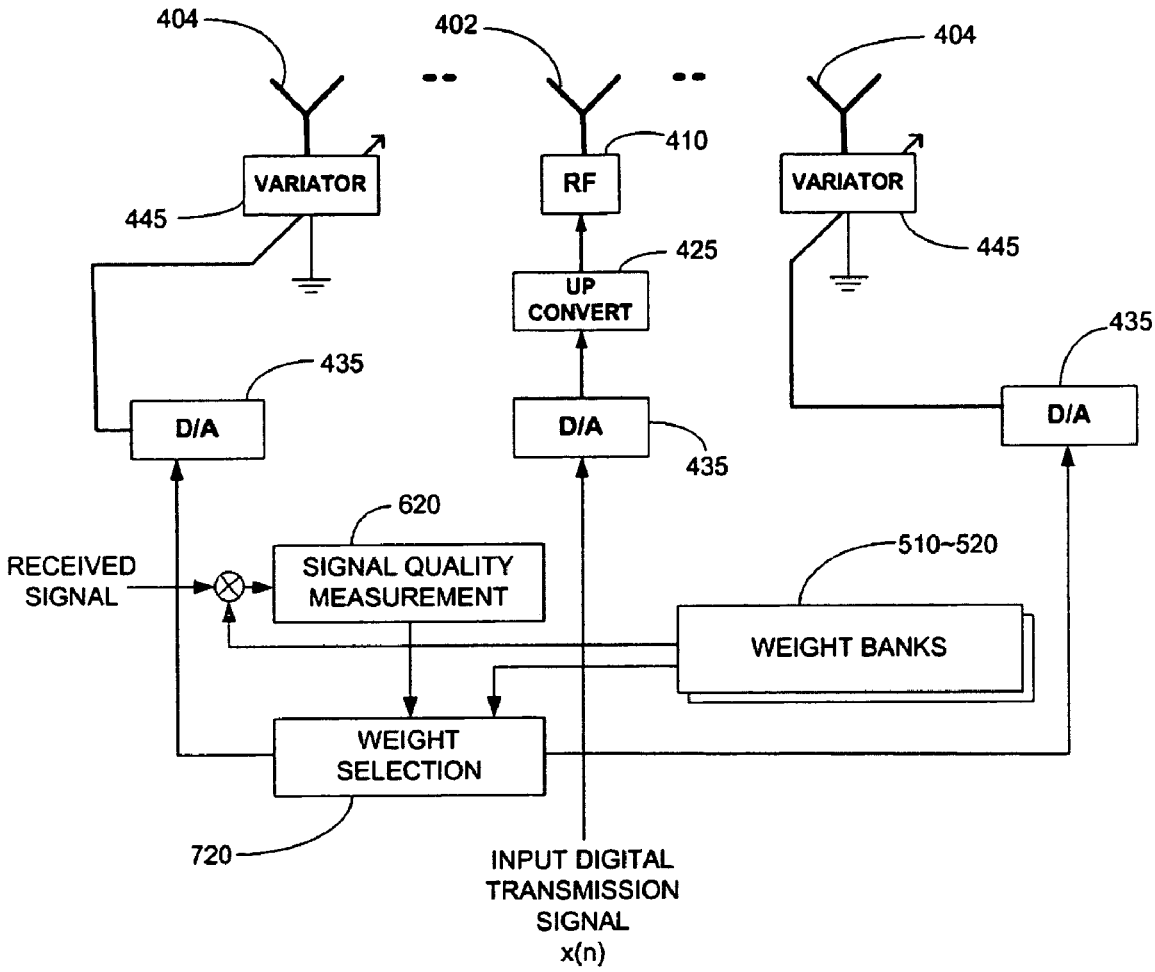
FIG. 10 illustrates a transmission beam-forming system using an antenna array containing one or more parasitic antenna elements, in accordance with an embodiment of the present invention.

FIG. 10 depicts yet another embodiment of the present invention, in which a transmission beam-forming system employs an antenna array containing one or more parasitic antenna elements. In this embodiment, the transmission beam-forming weights are selected from the same weight bank as for the reception beam-forming. Transmission beam-forming weights may be selected based on the measurement of received signal quality (i.e. the weights associated with the best received signal quality are applied to the transmitted signal). Other methods of transmission weight selection may be employed with this embodiment as well.

Once the best weights have been determined by the weight selection unit 720, digital-to-analog (D/A) converters 435 convert the digitally stored weights into analog signals and control the impedance of variators 445. By adjusting the impedance of variators 445, the electromagnetic fields of the parasitic antenna elements 404 will change so that the beam pattern of the active antenna elements 402 can be manipulated in order to steer the antenna pattern and transmitted RF signal toward a desired look direction.

While specific embodiments of the invention have been described above, it will be appreciated that the invention may be practiced otherwise than as described. As such, the configuration, operation, and behavior of the present invention has been described with the understanding that modifications and variations of the embodiments are possible, given the level of detail present herein. Thus, the preceding detailed description is not meant or intended to, in any way, limit the invention—rather the scope of the invention is defined by the appended claims.

What is claimed is:

1. A wireless communication system, comprising:

an antenna array structure having a plurality of antenna elements that receive and transmit radio-frequency signals;

a plurality of radio-frequency units and frequency converters configured to transform received RF signals to receive analog base-band signals and transform analog transmit base-band signals into a transmit RF signals;

a plurality analog-to-digital converters configured to convert the receive analog base-band signals into a receive digital base-band signals and a plurality of digital-to-analog converters configured to convert transmit digital base-band signals into transmit analog base-band signals;

a multipath delay profile estimation unit configured to estimate delays of multipath signal components based on the receive digital base-band signals; and a plurality of beam-forming units configured to process the multipath signal components, wherein each of the beam-forming units comprises:

(a) a set of hierarchical weight banks that store pre-calculated weights in accordance with pre-specified beam look directions, wherein the pre-calculated weights are calculated based on predetermined mathematical models that are independent of signal metrics; and (b) a digital processing unit configured to search for, and operate with, a best beam look direction by:

(i) estimating a signal metric from each of the pre-specified beam look directions corresponding to a first level of the hierarchical weight banks;

(ii) refining the beam look direction search by iteratively selecting the pre-calculated weights from remaining levels of the hierarchical weight banks that yield a desired quality of the estimated signal metric to obtain the best beam look direction; and (iii) applying the pre-calculated weights that yield the best signal metric to the received digital signal to shift a beam pattern to point to the best beam look direction.

2. The wireless communication system of claim 1, further comprising:

a combining mechanism configured to combine signal components from the beam-forming units in the presence of the multipath signal components.

3. The wireless communication system of claim 1, wherein the antenna elements are configured as at least one of omni-directional and/or sectorized elements.

4. The wireless communication system of claim 1, wherein the pre-calculated weights are applied to the digital receive base-band signal.

5. The wireless communication system of claim 1, wherein the antenna array structure comprises at least one linear array.

6. The wireless communication system of claim 5, wherein a mirror beam is used to support searching of an azimuth angle greater than 180 degrees.

7. The wireless communication system of claim 1, wherein the antenna array structure comprises at least one two dimensional antenna array.

8. The wireless communication system of claim 1, wherein the antenna array structure comprises at least one three dimensional antenna array.

9. The wireless communication system of claim 1, wherein pre-calculated weights are stored in a hierarchical weight bank structure.

10. The wireless communication system of claim 9, wherein the hierarchical weight bank structure comprises a binary tree.

11. The wireless communication system of claim 9, wherein the hierarchical weight bank structure comprises a B+ tree.

12. The wireless communication system of claim 1, wherein the multipath delay profile estimation unit detects multipath signal components of multiple received digital signals, separate the multipath signal components in the time domain, and distribute received multipath signal components to one or more beam-forming units.

13. The wireless communication system of claim 12, wherein each beam-forming unit processes a separate multipath signal component.

14. The wireless communication system of claim 1, wherein the signal metric comprises at least one of instant received power, bit error rate, frame error rate, signal-to-noise ratio, and signal-to-interference plus noise ratio.

15. The wireless communication system of claim 1, wherein the beam-forming units process the transmit digital base-band signals.

16. The wireless communication system of claim 15, wherein the beam-forming units apply the weights that correspond to the best received beam look direction to the transmit digital base-band signals.

17. The wireless communication system of claim 1, wherein the plurality of antenna elements include at least one active antenna element and a plurality of parasitic antenna elements, wherein each of the parasitic antenna elements are coupled to either an adjustable impedance component or electrical ground.

18. The wireless communication system of claim 17, wherein the selected pre-calculated weights are applied to the adjustable impedance components coupled to the parasitic antenna elements.

19. The wireless communication system of claim 17, wherein the antenna elements are configured as at least three omni-directional and/or sectorized antenna elements.

20. The wireless communication system of claim 18, wherein the selected pre-calculated weights are applied to the received analog radio-frequency signal by using the digital-to-analog converters to adjust the voltage levels of the adjustable impedance components coupled to the parasitic elements to control the beam pattern of the antenna array.

21. The wireless communication system of claim 1, further comprising an electronically controlled switch configured to multiplex receive signals from multiple antenna elements through one of the radio-frequency units, one of the frequency converters, and one or more of the analog-to-digital converters.

22. A wireless communication method, comprising:

transmitting and receiving radio-frequency signals through an antenna array structure having a plurality of antenna elements;

transforming received RF signals into receive analog base-band signals;

transforming transmit analog base-band signals into a transmit RF signals;

converting the receive analog base-band signals into receive digital base-band signals;

converting transmit digital base-band signals into transmit analog base-band signals;

estimating delays of multipath signal components based on the receive digital base-band signals;

establishing pre-set beam look directions;

pre-calculating weights associated with each pre-set beam look direction, wherein the pre-calculated weights are calculated based on predetermined mathematical models that are independent of signal metrics;

storing the pre-calculated weights in a hierarchical weight bank structure; and processing the multipath signal components via a plurality of beam-forming units, wherein each of the beam-forming units operate by:

(i) estimating a signal metric from each of the pre-specified beam look directions corresponding to a first level of the hierarchical weight banks;

(ii) refining the beam look direction search by iteratively selecting the pre-calculated weights from remaining levels of the hierarchical weight banks that yield a desired quality of the estimated signal metric to obtain the best beam look direction; and (iii) applying the pre-calculated weights that yield the best signal metric to the received digital signal to shift a beam pattern to point to the best beam look direction.

23. The method of claim 22, further comprising:

combining signal components from the beam-forming units in the presence of the multipath signal components.

24. The method of claim 22, wherein the pre-calculated weights are applied to the digital receive base-band signal.

25. The method of claim 22, wherein the antenna array structure comprises at least one linear array.

26. The method of claim 25, wherein a mirror beam is used to support searching of an azimuth angle greater than 180 degrees.

27. The method of claim 22, wherein the antenna array structure comprises at least one two dimensional array.

28. The method of claim 22, wherein the antenna array structure comprises at least one three dimensional array.

29. The method of claim 22, wherein the hierarchical weight bank structure comprises a binary tree.

30. The method of claim 22, wherein the hierarchical weight bank structure comprises a B+ tree.

31. The method of claim 22, wherein each beam-forming unit processes a separate multipath signal component.

32. The method of claim 22, wherein the signal metric comprises at least one of instant received power, bit error rate, frame error rate, signal-to-noise ratio, and signal-to-interference plus noise ratio.

33. The method of claim 22, wherein the beam-forming units process the transmit digital base-band signals.

34. The method of claim 22, wherein the beam-forming units apply the weights that correspond to the best received beam look direction to the transmit digital base-band signals.

35. The method of claim 22, wherein at least one of the antenna elements is a parasitic antenna element that is coupled to an adjustable impedance component.

36. The method of claim 35, where the antenna array structure comprises at least one parasitic antenna array having at least one active element and a plurality of parasitic elements which are coupled to the adjustable impedance components.

37. The method of claim 22, further comprising multiplexing received signals from a plurality of antenna elements through a single radio-frequency unit and a single frequency converter via an electrically-controlled switch, wherein the electrically controlled switch is in synchronization with sample clock of one or more analog-to-digital converters.

38. The method of claim 22, further comprising processing, via the beam-forming units, the transmit digital base-band signals.

39. The method of claim 38, wherein the beam-forming units apply the weights that correspond to the best received beam look direction to the transmit digital base-band signals.

40. A method of providing a set of pre-calculated weights to be used in a beam look direction search for wireless communications, the method comprising:

establishing one or more pre-set beam look directions;

for each pre-set beam look direction, computing the weights based on predetermined mathematical models that are independent of wireless communication signal metrics; and storing the weights in a multi-tiered hierarchical weight bank structure.

41. A system for providing a set of pre-calculated weights to be used in a beam look direction search for wireless communications, the system comprising:

a plurality of beam-forming units configured to process wireless communication signals in accordance with one or more pre-set beam look directions;

a set of multi-tiered hierarchical weight banks that store pre-calculated weights associated with the pre-specified beam look directions, wherein the pre-calculated weights are computed based on predetermined mathematical models that are independent of wireless communication signal metrics.

* * * * *